US012564752B2

(12) United States Patent
Kim et al.

(10) Patent No.: US 12,564,752 B2
(45) Date of Patent: Mar. 3, 2026

(54) METHOD AND APPARATUS FOR CONTROLLING TENSION OF STRING

(71) Applicant: Samsung Electronics Co., Ltd., Suwon-si (KR)

(72) Inventors: Donghyun Kim, Suwon-si (KR); Keehong Seo, Suwon-si (KR); Donghan Koo, Suwon-si (KR); Seungyong Hyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 98 days.

(21) Appl. No.: 18/525,219

(22) Filed: Nov. 30, 2023

(65) Prior Publication Data

US 2024/0115898 A1 Apr. 11, 2024

Related U.S. Application Data

(63) Continuation of application No. PCT/KR2023/002280, filed on Feb. 16, 2023.

(30) Foreign Application Priority Data

Feb. 25, 2022 (KR) ..... 10-2022-0025141

(51) Int. Cl.
*A63B 21/005* (2006.01)
*A63B 21/00* (2006.01)
*A63B 24/00* (2006.01)

(52) U.S. Cl.
CPC ..... *A63B 21/0058* (2013.01); *A63B 21/153* (2013.01); *A63B 24/0087* (2013.01)

(58) Field of Classification Search
CPC ..... A63B 21/0058; A63B 21/153; A63B 24/0087; A63B 2024/0093;
(Continued)

(56) References Cited

U.S. PATENT DOCUMENTS 7,588,518 B2 9/2009 Lastayo et al.
10,188,890 B2 1/2019 Olson et al.
(Continued)

FOREIGN PATENT DOCUMENTS

CN 113181592 A 7/2021
CN 113750466 A 12/2021
(Continued)

OTHER PUBLICATIONS

International Search Report for PCT/KR2023/002280 mailed May 19, 2023, 3 pages.
(Continued)

*Primary Examiner* — Bryan Earles
(74) *Attorney, Agent, or Firm* — Nixon & Vanderhye P.C.

(57) ABSTRACT

To control tension of a string of a tension control apparatus, a target operation mode of the tension control apparatus may be received, a first tension value may be generated by measuring tension of a string connected to a sensor using the sensor, a first control signal for controlling a motor connected to the string may be generated based on the first tension value and the target operation mode, and tension of the string may be controlled by controlling the motor based on the first control signal.

19 Claims, 13 Drawing Sheets

(58) Field of Classification Search
CPC ..... A63B 2220/51; A63B 2225/20; A63B 21/0442; A63B 21/0552; A63B 21/4043; A63B 23/1281; A63B 21/4035; A63B 2225/50; A63B 22/0007
See application file for complete search history.

(56) References Cited

U.S. PATENT DOCUMENTS

| | | | | |
|---|---|---|---|---|
| 10,758,767 | B2 | 9/2020 | Olson et al. | |
| 11,406,861 | B2 * | 8/2022 | Lafrance | A63B 24/0087 |
| 2016/0101322 | A1 * | 4/2016 | Potter | A63B 21/153 482/6 |
| 2018/0021616 | A1 * | 1/2018 | Orady | A63B 21/16 482/5 |
| 2019/0041276 | A1 * | 2/2019 | Oh | H02K 7/116 |
| 2019/0099637 | A1 * | 4/2019 | Valente | A63B 21/0058 |
| 2019/0099652 | A1 | 4/2019 | Orady et al. | |
| 2019/0134454 | A1 * | 5/2019 | Mahoney | A63F 13/24 |
| 2020/0393904 | A1 * | 12/2020 | Sinclair | G05G 13/00 |
| 2021/0394023 | A1 | 12/2021 | Belson et al. | |

FOREIGN PATENT DOCUMENTS

| | | | |
|---|---|---|---|
| KR | 20130136699 | A | 12/2013 |
| KR | 20160145123 | A | 12/2016 |
| KR | 101958908 | B1 | 3/2019 |
| KR | 102084013 | B1 | 3/2020 |

OTHER PUBLICATIONS

Written Opinion of the ISA for PCT/KR2023/002280 mailed May 19, 2023, 3 pages.

* cited by examiner

METHOD AND APPARATUS FOR CONTROLLING TENSION OF STRING

CROSS-REFERENCE TO RELATED APPLICATIONS

This application is a continuation of International Application No. PCT/KR2023/002280 designating the United States, filed on Feb. 16, 2023, in the Korean Intellectual Property Receiving Office and claiming priority to Korean Patent Application No. 10-2022-0025141, filed on Feb. 25, 2022, in the Korean Intellectual Property Office, the disclosures of each of which are incorporated by reference herein in their entireties.

BACKGROUND

Field

The disclosure relates to a technique for controlling the tension of a string, and for example, to a technique for controlling the tension of a string when one end of the string is pulled by a load.

Description of Related Art

In general, when a user performs an upper body exercise using equipment, the user may achieve different effects depending on the degree of muscle relaxation or contraction even though exercising using the same load (or weight). For example, the user may perform standing barbell curls, preacher curls, and spider curls, respectively, for stimulating the growth of different arm muscles, and each exercise may provide different stimulation depending on the angle of the user's elbows. The user may need to take different poses to perform standing barbell curls, preacher curls, and spider curls, respectively, using a barbell.

SUMMARY

According to an example embodiment, a method of controlling tension of a string (e.g., cable) of a tension control apparatus, performed by the tension control apparatus, includes: receiving a target operation mode of the tension control apparatus, generating a first tension value by measuring tension of a string connected to at least one sensor using the sensor, generating a first control signal for controlling a motor connected to the string based on the first tension value and the target operation mode, and controlling tension of the string by controlling the motor based on the first control signal, wherein the string may be connected to an elastic member comprising an elastic material (e.g., an elastic band), and a tension may be applied to the string using the elastic member.

The receiving of the target operation mode may include: receiving the target operation mode, generating an initial control signal for controlling the motor so that the string has initial tension specified for the target operation mode, and controlling the tension of the string by controlling the motor based on the initial control signal.

The receiving of the target operation mode may further include: receiving a target intensity for the target operation mode, and the generating of the initial control signal may include: generating the initial control signal for controlling the motor so that the string has the initial tension specified for the target operation mode and the target intensity.

The target operation mode may include an offset operation mode in which the length of the string located between the motor and the elastic member does not change even when tension is applied to the string by the user.

The target operation mode may include an ascending operation mode in which the length of the string located between the motor and the elastic member decreases based on the tension applied to the string by the user increasing.

The ascending operation mode may include an operation mode in which the length of the string located between the motor and the elastic member increases based on the tension applied to the string decreasing after reaching a maximum value.

The target operation mode may include a descending operation mode in which the length of the string located between the motor and the elastic member increases based on the tension applied to the string by the user increasing.

The descending operation mode may include an operation mode in which the length of the string located between the motor and the elastic member decreases based on the tension applied to the string decreasing after reaching a maximum value.

The generating of the first control signal for controlling the motor connected to the string based on the first tension value and the target operation mode may include: determining whether the first tension value exceeds a maximum tension value, updating the maximum tension value with the first tension value based on the first tension value exceeding the maximum tension value, determining a current state as a tension increase state based on the maximum tension value being updated, and generating the first control signal for controlling the motor connected to the string based on the first tension value and the tension increase state of the target operation mode.

The generating of the first control signal for controlling the motor connected to the string based on the first tension value and the target operation mode may include: determining whether the first tension value exceeds a maximum tension value, calculating a difference between the first tension value and the maximum tension value based on the first tension value not exceeding the maximum tension value, determining a current state as a tension decrease state based on the difference being greater than or equal to a specified threshold value, and generating the first control signal for controlling the motor connected to the string based on the first tension value and the tension decrease state of the target operation mode.

The string may include a plurality of strings, and the motor may be a twisted string actuator (TSA) configured to control twisting of the plurality of strings.

The motor may be configured to control tension of the string by winding or unwinding the string on a rotating shaft of the motor.

The string may include a first string and a second string, wherein the first string of the string may be connected to a first elastic member, and the second string of the string may be connected to a second elastic member.

According to an example embodiment, a tension control apparatus includes: a string having a first end connected to an elastic member comprising an elastic material and a second end connected to a motor, at least one sensor configured to generate a first tension value by measuring tension of the string, and a controller configured to generate a first control signal for controlling the motor based on the first tension value received from the sensor and a set target operation mode, a motor driver circuit configured to control tension of the string by controlling the motor based on the first control signal, and the motor electrically connected to the motor driver circuit, wherein a user may apply tension to the string using the elastic member.

The tension control apparatus may further include at least one user interface configured to receive the target operation mode.

The tension control apparatus may further include a communication module comprising communication circuitry configured to receive the target operation mode from a user terminal.

The string may include a plurality of strings, and the motor may include a twisted string actuator (TSA) configured to control twisting of the plurality of strings.

The motor may be configured to control tension of the string by winding or unwinding the string on a rotating shaft of the motor.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Hereinafter, various example embodiments of the present disclosure will be described with reference to the accompanying drawings. However, this is not intended to limit the present disclosure to specific embodiments, and it should be understood that various modifications, equivalents, and/or alternatives of the embodiments of the present disclosure are included.

Figure 1:
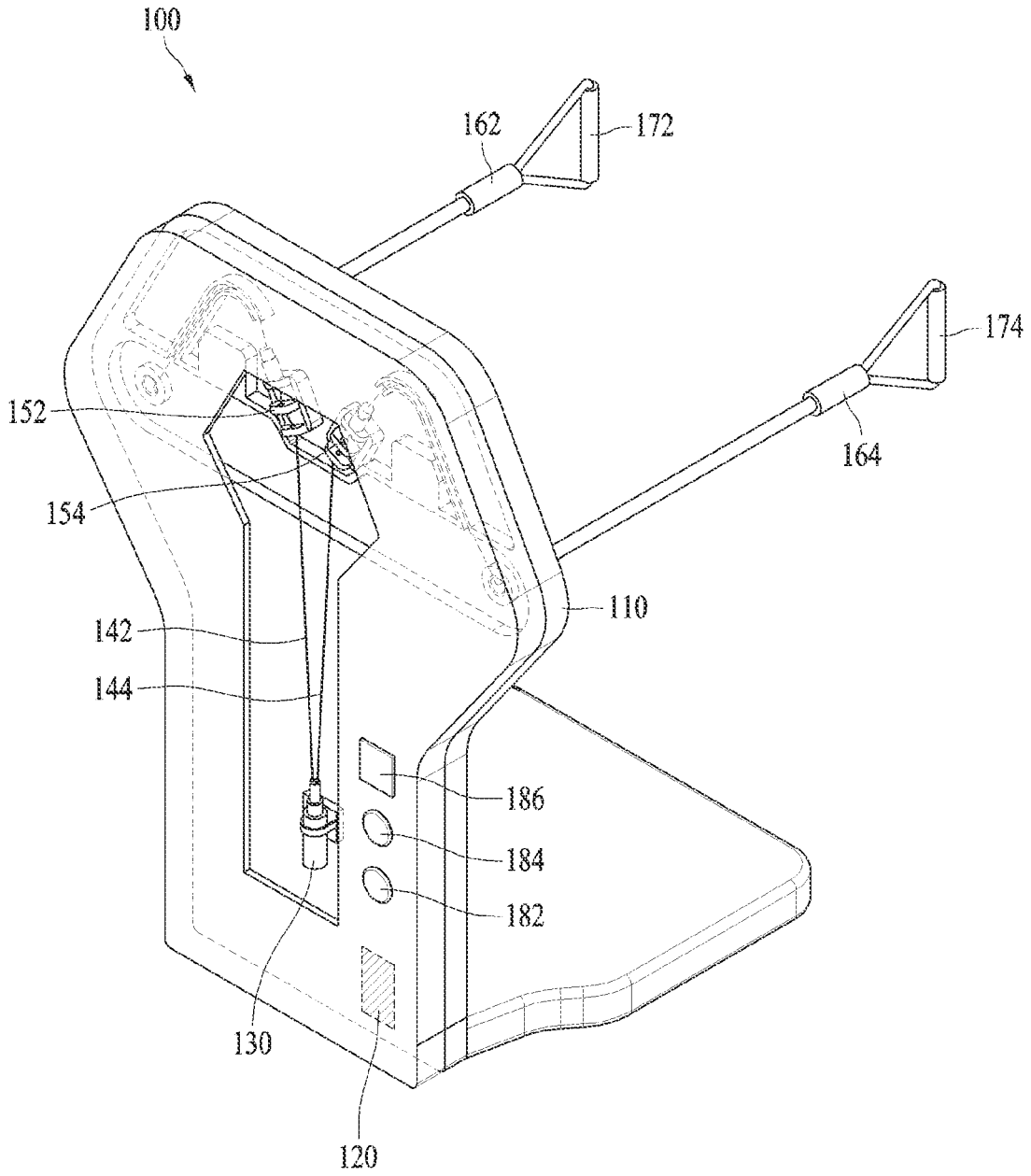
FIG. 1 is a perspective view illustrating an example structure of a chair-type upper body exercise apparatus according to various embodiments.

FIG. 1 is a perspective view illustrating an example structure of a chair-type upper body exercise apparatus according to various embodiments.

Referring to FIG. 1, a chair-type upper body exercise apparatus 100 (hereinafter, referred to an exercise apparatus) according to an embodiment may support a user. The exercise apparatus 100 may support the users hips and back. The user may perform various exercises while seating on the exercise apparatus 100. The exercise apparatus may also be referred to as a tension control apparatus.

The exercise apparatus 100 may, for example, and without limitation, have a chair shape. The exercise apparatus 100 may be used as a general chair. The user may perform a desired exercise by gripping elastic members 162 and 164 and/or handles 172 and 174 selectively only when the user desires an exercise.

The user may perform various exercises using the exercise apparatus 100. For example, the user may perform at least one of an arm exercise, a shoulder exercise, and a chest exercise using the exercise apparatus 100.

According to an embodiment, the exercise apparatus 100 may include a chair 110, a motor 130, a pair of strings 142 and 144, a pair of splitters 152 and 154, a pair of elastic members 162 and 164, a pair of handles 172 and 174, a controller (e.g., including control/processing circuitry) 120, a first control button 182, a second control button 184, and a display 186. Additionally, the exercise apparatus 100 may further include a hip cushion and a back cushion.

The chair 110 may support the user. The chair 110 may include a hip support for supporting the user's hips and a back support for supporting the user's back. Although not shown, the chair 110 may include a plurality of legs connected to the hip support. The hip support and the back support may be connected to each other. For example, the hip support and the back support may be integrally formed. For example, the hip support and the back support may be connected to each other using separate connecting members.

The back support may have a hollow therein. Various components for generating a load for exercise may be provided inside the back support. For example, the motor 130, at least a portion of the pair of strings 142 and 144, and the pair of splitters 152 and 154 may be provided inside the back support. At least a portion of each of the pair of strings (which may also be referred to as "cables" or the like) 142 and 144 may be provided inside the back support, and the remaining portion thereof may be provided outside the back support. The back support may include a front frame facing the user's back, a rear frame connected to the front frame, and glass (not shown) disposed on the rear frame.

For example, the glass may be provided in the central portion of the rear frame. The glass may include a transparent material. The user may check the components (e.g., the motor 130, the strings 142 and 144, and the splitters 152 and 154) inside of the back support through the glass.

The hip support may have a hollow therein. For example, the hip support may receive at least a portion of a pipe for increasing the stiffness of the chair.

The plurality of legs (not shown) of the chair 110 may separate the hip support from the ground. It should be noted that the number of legs sufficient to stably support the hip support may be, for example, "4", and is not limited thereto.

The motor 130 may generate a load for exercise. The motor 130 may be provided inside the back support. According to one example, the motor 130 may twist or untwist the pair of strings 142 and 144. For example, the motor 130 may twist the pair of strings 142 and 144 by operating (or rotating) in a first direction. When the degree of twisting of the pair of strings 142 and 144 increases, the length of the pair of strings 142 and 144 exposed to the outside of the back support may decrease. For example, the motor 130 may untwist the pair of strings 142 and 144 by operating (or rotating) in a second direction. When the degree of twisting of the pair of strings 142 and 144 decreases, the length of the pair of strings 142 and 144 exposed to the outside of the back support may increase.

The pair of strings 142 and 144 may have a first end connected to the motor 130 and a second end provided outside the back support. The pair of strings 142 and 144 may include a first string 142 and a second string 144. Each of the first string 142 and the second string 144 may be connected to the motor 130 at a different position. For example, based on the portion connected to the motor 130, the first string 142 and the second string 144 may be spaced apart from each other. At least one string of the first string 142 and the second string 144 may be connected to the motor 130 at a position spaced apart from the rotating shaft of the motor 130.

The pair of strings 142 and 144 may include a material that is not elastically deformed. For example, the pair of strings 142 and 144 may include a material with relatively little elasticity compared to the pair of elastic members 162 and 164 (e.g., elastic bands).

The pair of splitters 152 and 154 may be disposed inside the back support and provided at positions spaced apart from the motor 130. The pair of splitters 152 and 154 may include a first splitter 152 supporting the first string 142 and a second splitter 154 supporting the second string 144. The pair of splitters 152 and 154 may be provided at positions spaced apart from the motor 130. For example, the pair of splitters 152 and may be provided at positions spaced upward from the motor 130. Positioning the relatively heavy motor 130 close to the hip support may improve structural stability. The pair of splitters 152 and 154 may support the pair of strings 142 and 144 while being spaced apart from the motor 130. For example, the portion of the pair of strings 142 and provided on the side toward the motor 130 based on the pair of splitters 152 and 154 (e.g., the lower end portion of the strings 142 and 144) may be twisted in response to the operation of the motor 130. The portion of the pair of strings 142 and 144 provided on the side opposite to the motor 130 based on the pair of splitters 152 and 154 (e.g., the upper end portion of the strings 142 and 144) may not be twisted with each other even when the motor 130 operates. The pair of splitters 152 and 154 may set a maximum range in which the first string 142 and the second string 144 may be twisted with each other.

According to an embodiment, at least one (e.g., the splitter 152) of the pair of splitters 152 and 154 may include a sensor. The sensor may be a sensor for measuring tension of a string (e.g., the string 142) associated with the splitter 152. For example, the sensor may be a load cell. Due to the tension applied to the string 142 passing through the splitter 152, the string 142 may apply pressure to the load cell. The load cell may generate a tension value of the string 142 by measuring the applied pressure.

The pair of elastic members 162 and 164 may include a first elastic member 162 connected to the first string 142 and a second elastic member 164 connected to the second string 154. The pair of elastic members 162 and 164 may include a material that is elastically deformed. For example, the pair of elastic members 162 and 164 may include a material with relatively great elasticity compared to the pair of strings 142 and 144.

The pair of handles 172 and 174 may include a first handle 172 connected to the first elastic member 162 and a second handle 174 connected to the second elastic member 164. For example, each of the pair of handles 172 and 174 may include a receiving portion for accommodating the user's hand and a rod portion provided to be gripped by the user. For example, each of the pair of handles 172 and 174 may have a triangular shape. It should be noted that the shape of the handles is not limited thereto.

The controller 120 may include various processing/control circuitry and control driving of the motor 130. The controller 120 may control an operating direction of the motor 130 or control a rotational strength of the motor 130. The controller 120 may be electrically connected to the motor 130. Based on the driving of the motor 130, the degree of twisting of the first string 142 and the second string 144 may be adjusted.

The first control button 182 may be disposed on the chair 110 and may be used to receive an operation mode of the exercise apparatus 100 desired by the user from the user. For example, the operation mode may include a power-off mode, an offset operation mode, an ascending operation mode, and a descending operation mode, and is not limited thereto.

The second control button 184 may be disposed on the chair 110 and may be used to receive an exercise intensity of the exercise apparatus 100 desired by the user from the user. For example, the exercise intensity may include a first intensity, a second intensity, and a third intensity, and is not limited thereto.

The display 186 may display at least one of an operation mode and an exercise intensity currently set in the exercise apparatus 100.

According to an embodiment, the exercise apparatus 100 may further include a communication module (not shown). For example, the communication module may include various communication circuitry and transmit/receive data to/from an external user terminal (e.g., a smartphone, a smartwatch, a tablet, etc.) using short-range wireless communication. The user may control the exercise apparatus 100 through an application installed on the user terminal. For example, the user may control at least one of the operation mode and the exercise intensity of the exercise apparatus 100 through the application. In another example, the exercise apparatus 100 may transmit information about the user's exercise result to the user terminal through the communication module. For example, the information about the exercise result may include an operation mode, an exercise intensity, an exercise duration, a trajectory change in the tension of strings during exercise, and estimated calories consumed.

According to an embodiment, the user may input the user's body information to the application on the user terminal, and the application may generate an exercise analysis report as feedback based on the user's body information and the exercise result. For example, the exercise analysis report may be a suggestion for performing a more efficient exercise for the type of exercise performed by the user. For example, the suggestion may include contents such as an arm extending direction, an elbow folding speed, an elbow extending speed, a wrist twisting degree, and the like, and is not limited thereto.

Hereinafter, a method of controlling the tension of a string by the exercise apparatus 100 to provide an appropriate load to the user when the user performs an exercise using the exercise apparatus 100 will be described in greater detail.

Figure 2:
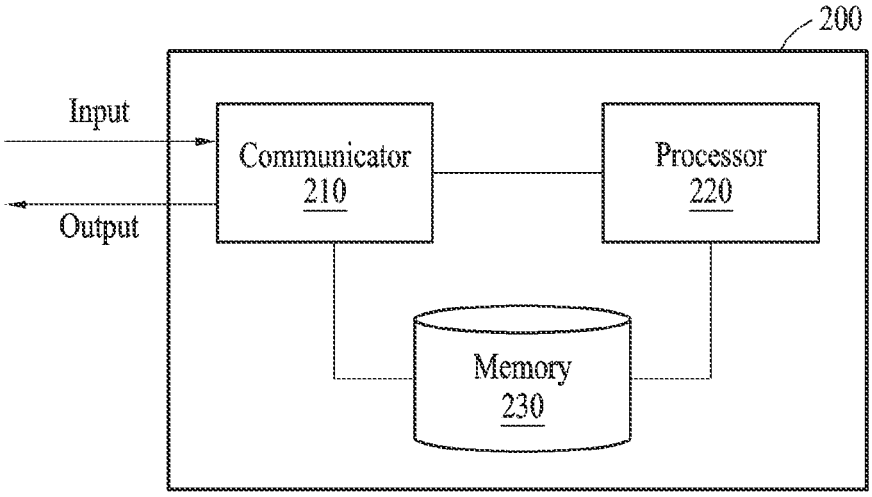
FIG. 2 is a block diagram illustrating an example configuration of a controller according to various embodiments.

FIG. 2 is a block diagram illustrating an example configuration of a controller according to various embodiments.

According to an embodiment, a controller 200 (e.g., the controller 120 of FIG. 1) of an exercise apparatus (e.g., the exercise apparatus 100 of FIG. 1) may include a communicator (e.g., including communication circuitry) 210, a processor (e.g., including processing circuitry) 220, and a memory 230.

The communicator 210 is connected to the processor 220 and the memory 230, includes various communication circuitry, and transmits and receives data to and from the processor 220 and the memory 230. For example, the communicator 210 may be connected to the other electronic elements of the exercise apparatus and transmit and receive data to and from the other electronic elements. Hereinafter, transmitting and receiving "A" may refer to transmitting and receiving "information or data indicating A".

The communicator 210 may be implemented as a circuitry in the controller 200. For example, the communicator 210 may include an internal bus and an external bus. In another example, the communicator 210 may be an element that connects the controller and an external device. The communicator 210 may be an interface. The communicator 210 may receive data from the external device and transmit the data to the processor 220 and the memory 230.

The processor 220 may include various processing circuitry and process the data received by the communicator 210 and data stored in the memory 230. A "processor" may be a hardware-implemented data processing device having a physically structured circuit to execute desired operations. For example, the desired operations may include code or instructions included in a program. For example, and without limitation, the hardware-implemented data processing device may include a microprocessor, a central processing unit (CPU), a processor core, a multi-core processor, a multiprocessor, an application-specific integrated circuit (ASIC), and a field-programmable gate array (FPGA).

The processor 220 may execute a computer-readable code (for example, software) stored in a memory (for example, the memory 230) and instructions triggered by the processor 220.

The memory 230 stores the data received by the communicator 210 and data processed by the processor 220. For example, the memory 230 may store the program (or an application, or software). The program to be stored may be a set of syntaxes that are coded and executable by the processor 220 to control the tension of a string.

The memory 230 may include, for example, at least one volatile memory, nonvolatile memory, random-access memory (RAM), flash memory, a hard disk drive, and an optical disc drive.

The memory 230 may store an instruction set (e.g., software) for operating the controller 200. The instruction set for operating the controller 200 may be executed by the processor 220.

The controller 200 will be described in greater detail below with reference to FIGS. 3 to 13.

Figure 3:
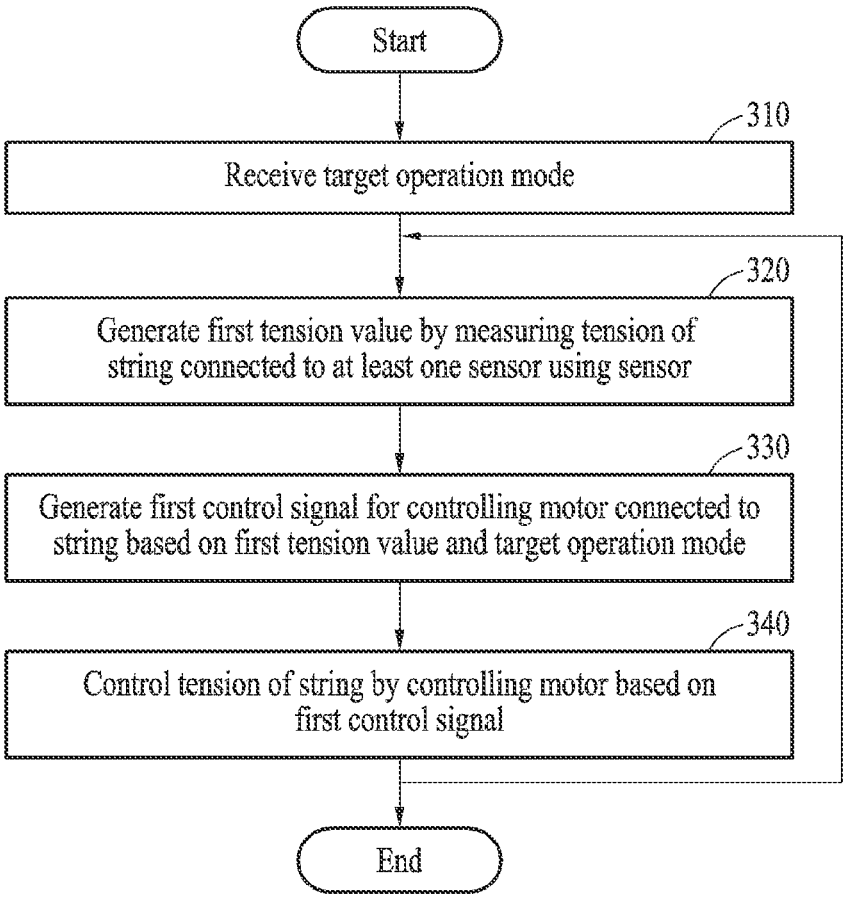
FIG. 3 is a flowchart illustrating an example method of controlling tension of a string according to various embodiments.

FIG. 3 is a flowchart illustrating an example method of controlling tension of a string according to various embodiments.

According to an embodiment, the following operations 310 to 340 may be performed by the controller 200 described above with reference to FIG. 2.

In operation 310, the controller 200 may receive a target operation mode. For example, the controller 200 may receive a target operation mode among a plurality of exercise modes through the first control button 182 of the exercise apparatus 100 described above with reference to FIG. 1. In another example, the controller 200 may receive information about the target operation mode from an external user terminal through the communication module of the exercise apparatus 100.

According to an embodiment, the plurality of exercise modes may include an offset exercise mode, an ascending operation mode, and a descending exercise mode. For example, the offset mode may be an operation mode in which the length of the strings 142 and 144 located between the motor 130 and the elastic members 162 and 164 does not change even when tension is applied to the strings 142 and 144 of the exercise apparatus 100 by the user. For example, the offset mode may be a mode in which the preset degree of twisting of the strings 142 and 144 does not change during exercise. The preset degree of twisting of the strings 142 and 144 may vary depending on the exercise intensity. For example, the strings 142 and 144 may be twisted more when a second intensity, which is a middle exercise intensity, is set for the exercise apparatus 100, compared to when a first intensity, which is a low exercise intensity, is set for the exercise apparatus 100.

When the target operation mode is received, the controller 200 may perform initial control of the exercise apparatus. The method for initial control of the exercise apparatus will be described in greater detail below with reference to FIG. 4.

In operation 320, the controller 200 generates a first tension value by measuring the tension of a string (e.g., the string 152 of FIG. 1) connected to at least one sensor (e.g., the load cell of the splitter 152 of FIG. 1) using the sensor.

The first tension value generated while the user performs an exercise using the exercise apparatus may change as time passes.

In operation 330, the controller 200 may generate a first control signal for controlling a motor (e.g., the motor 130 of FIG. 1) connected to the string based on the first tension value and the target operation mode.

Since the generated first tension value may change as time passes, the generated first control signal may also change as time passes.

In operation 340, the controller 200 may control the tension of the string by controlling the motor based on the first control signal.

According to an embodiment, the exercise apparatus may further include a motor driver circuit configured to generate a first driving signal corresponding to the first control signal received from the controller 200. The motor driver circuit may control the motor based on the first driving signal.

According to an embodiment, the twisting of the strings (e.g., the strings 142 and 144) may be adjusted by rotation of the motor. For example, when the motor rotates in a first direction, the twisting of the strings may be alleviated, and when the motor rotates in a second direction, the twisting of the strings may be enhanced. When the twisting of the strings is alleviated, the tension value measured by the sensor may decrease, and conversely, when the twisting of the strings is enhanced, the tension value measured by the sensor may increase. When the tension of the string decreases, the user may feel the load applied to an elastic member (e.g., the elastic member 152) decreases. Conversely, when the tension of the string increases, the user may feel the load applied to the elastic member (e.g., the elastic member 152) increases. Different exercise methods may be provided to the user using such changes in the load that the user feels.

According to an embodiment, based on the range of motion (ROM) with respect to the angle of the user's elbows, an exercise method that increases the load as the flexion of the joints decreases (e.g., as the joints extend) may be provided. For example, the above exercise method may be spider curls. An exercise mode in which an exercise method such as spider curls is provided may be the ascending exercise mode. In the ascending exercise mode, the motor may be controlled so that the strings are wound as the user extends the elbows.

According to an embodiment, based on the ROM with respect to the angle of the user's elbows, an exercise method that decreases the load as the flexion of the joints decreases (e.g., as the joints extend) may be provided. For example, the above exercise method may be preacher curls. An exercise mode in which an exercise method such as preacher curls is provided may be the descending exercise mode. In the ascending exercise mode, the motor may be controlled so that the strings are twisted as the user extends the elbows.

According to an embodiment, when the operation mode is the offset mode, the motor may not operate while the user performs an exercise. Since the motor does not operate, the tension by the twisting of the strings may not change. When the tension by the twisting of the string does not change, the user may feel the load applied to the elastic member (e.g., the elastic member 152) is constant.

When the user's joints return to the direction of the minimum ROM after reaching the maximum ROM (e.g., when the elbows bend), the rotation direction of the motor may be reversed. For example, in the ascending operation mode, the motor may be controlled to untwist the strings. In another example, in the descending operation mode, the motor may be controlled to increase the twisting of the strings.

The above descriptions are for the case where the user performs an exercise while sitting with his or her back on the exercise apparatus (e.g., the case where the user starts with the elbows bending), and, for example, for the case where the user performs an exercise while facing the exercise apparatus (e.g., the case where the user starts with the elbows extending), the motor may be controlled reversely to the descriptions.

Figure 4:
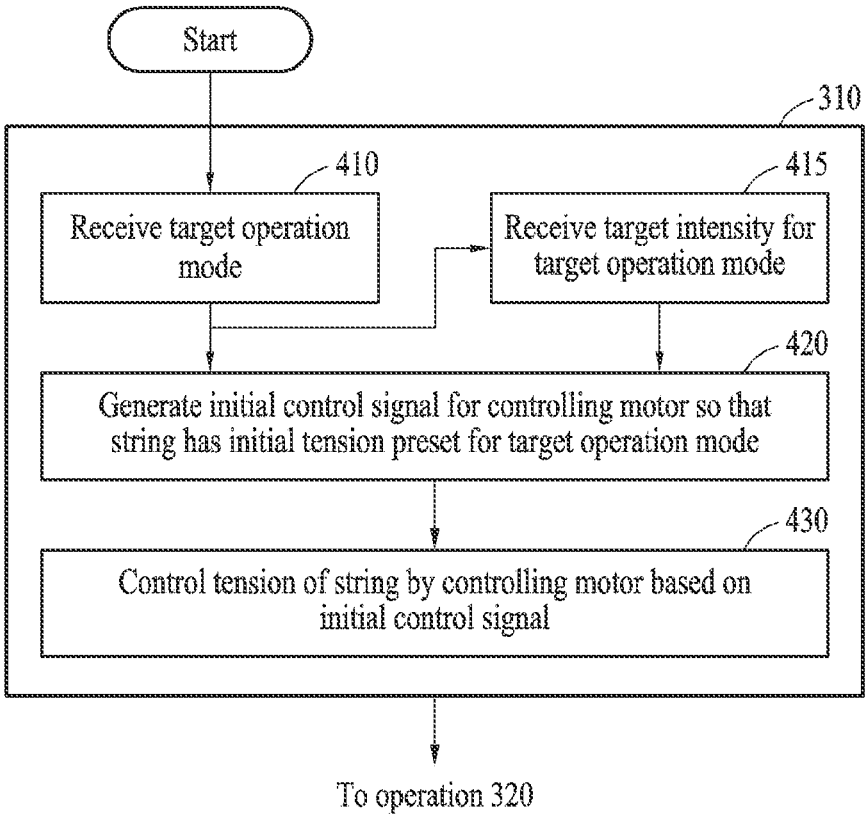
FIG. 4 is a flowchart illustrating an example method of controlling tension of a string based on an initial control signal associated with a target operation mode according to various embodiments.

FIG. 4 is a flowchart illustrating an example method of controlling tension of a string based on an initial control signal associated with a target operation mode according to various embodiments.

According to an embodiment, operation 310 described above with reference to FIG. 3 may include operations 410 to 430 to be described in greater detail below.

In operation 410, the controller 200 may receive a target operation mode. For example, the target operation mode may be an offset operation mode, an ascending operation mode, or a descending operation mode.

In operation 415, the controller 200 may receive a target intensity for the target operation mode. For example, the target intensity may be a first intensity, a second intensity, or a third intensity.

In operation 420, the controller 200 may generate an initial control signal for controlling the motor so that the strings have initial tension preset (e.g., specified) for the target operation mode. For example, when the target intensity is further received, the controller 200 may generate the initial control signal based on the target operation mode and the target intensity. The stronger the target intensity, the stronger the load may be set.

In operation 430, the controller 200 may control the tension of the string by controlling the motor based on the initial control signal. For example, the motor may be controlled so that the string has initial tension.

According to an embodiment, in the offset operation mode, the initially set twisting of the strings may be maintained even during exercise.

According to an embodiment, in the ascending operation mode, the initially set twisting of the strings may be changed during exercise. For example, the strings may be more twisted to increase the load in an elbow extension motion, and the strings may be untwisted to decrease the load in a subsequent elbow flexion motion. When the user completes a single motion, the twisting of the strings may be the same as or similar to an initial state.

According to an embodiment, in the descending operation mode, the initially set twisting of the strings may be changed during exercise. For example, the strings may be untwisted to decrease the load in an elbow extension motion, and the strings may be twisted again to increase the load in a subsequent elbow flexion motion. When the user completes a single motion, the twisting of the strings may be the same as or similar to an initial state.

Figure 5:
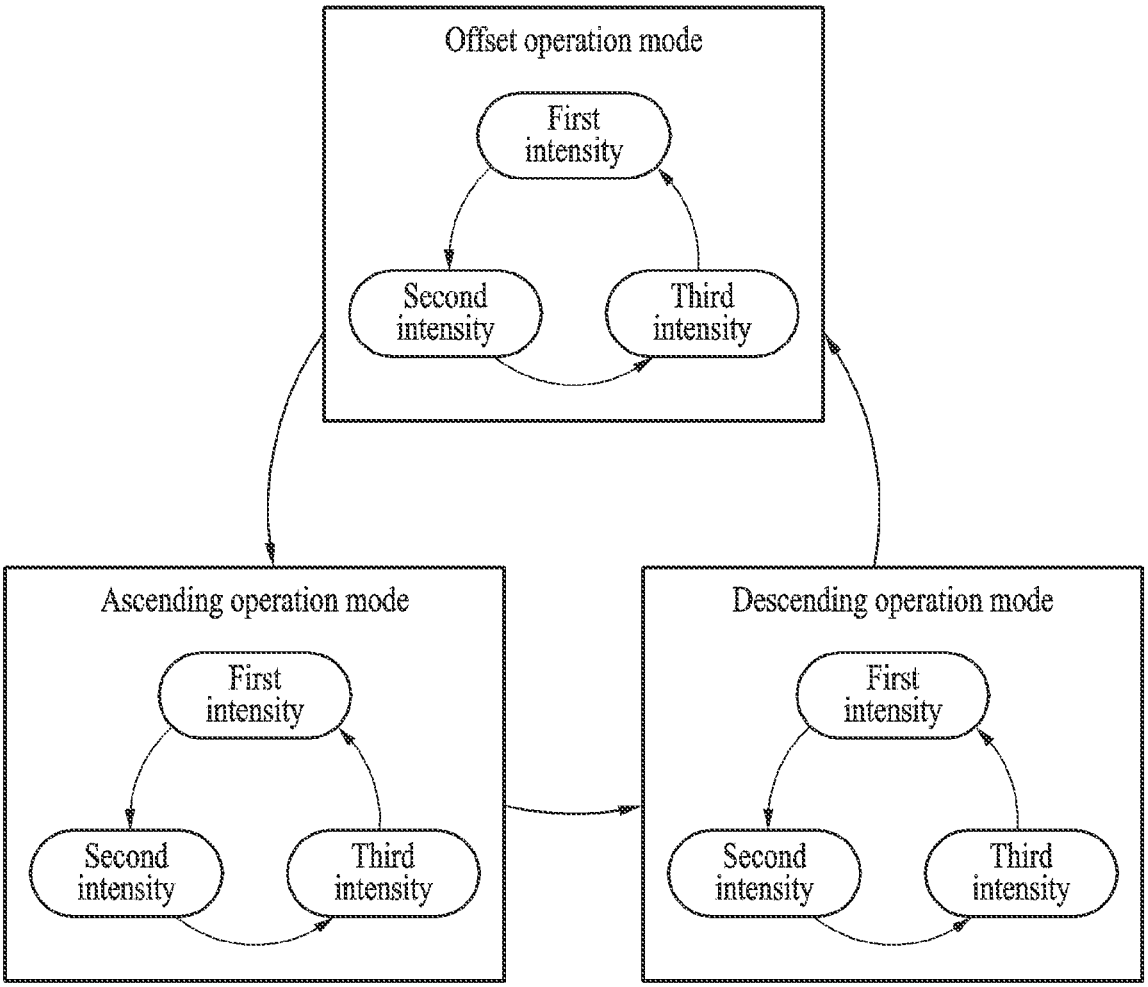
FIG. 5 is a diagram illustrating examples of transition between a plurality of operation modes according to various embodiments.

FIG. 5 is a diagram illustrating example transitions between a plurality of operation modes according to various embodiments.

According to an embodiment, a user may input a desired operation mode to an exercise apparatus through a user interface (e.g., a first button) of the exercise apparatus or a user terminal wirelessly connected to the exercise apparatus. For example, when the user presses a button for selecting an exercise mode, the selected operation mode may be changed in the order of an offset operation mode, an ascending operation mode, and a descending operation mode.

When a specific operation mode is selected, the user may additionally set an exercise intensity for the corresponding operation mode. For example, the user may input a desired exercise intensity to the exercise apparatus through a user interface (e.g., a second button) of the exercise apparatus or the user terminal. For example, when the user presses the second button, the selected exercise intensity may be changed in the order of a first intensity, a second intensity, and a third intensity.

Figure 6:
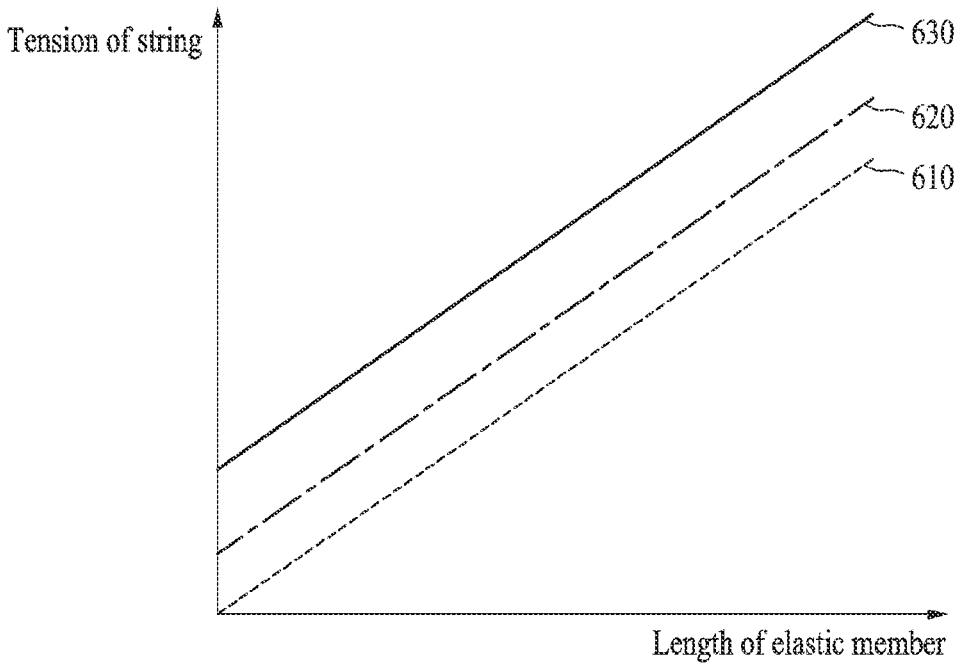
FIG. 6 is a graph illustrating the relationship between the length of an elastic member and the tension of a string in an offset operation mode according to various embodiments.

FIG. 6 is a graph illustrating the relationship between the length of an elastic member and the tension of a string in an offset operation mode according to various embodiments.

When an offset operation mode is set for an exercise apparatus, the twisting of strings may not change during exercise. A user may adjust an exercise intensity by adjusting the initially set degree of twisting of the strings.

For example, a first trajectory 610 may correspond to a first intensity, a second trajectory 620 may correspond to a second intensity, and a third trajectory 630 may correspond to a third intensity. When the exercise intensity is set to the first intensity, the twisting of the strings may be less than those for the second intensity and the third intensity, to provide a load lower than the second intensity and the third intensity to the user. Conversely, when the exercise intensity is set to the third intensity, the twisting of the strings may be more than those for the first intensity and the second intensity, to provide a load higher than the first intensity and the second intensity to the user.

The user may perform an exercise that increases or decreases the length of an elastic member connected to a string. As the user's force is applied to the elastic member, the tension of the string connected to the elastic member may increase. It can be learned the measured tension value of the string increases overall in proportion to the increased length of the elastic member in the offset operation mode.

Figure 7:
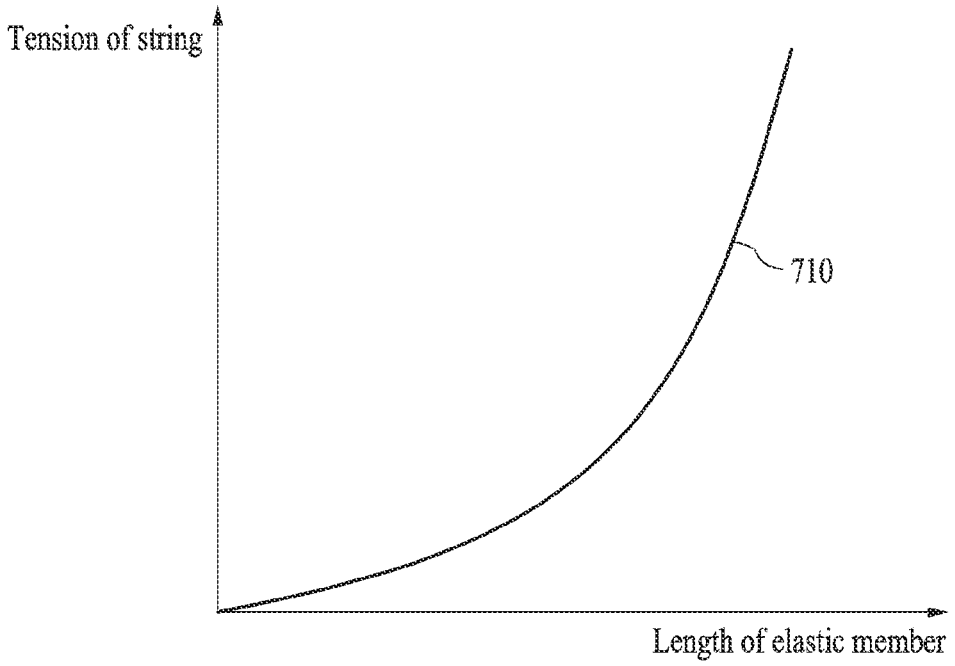
FIG. 7 is a graph illustrating the relationship between the length of an elastic member and the tension of a string in an ascending operation mode according to various embodiments.

FIG. 7 is a graph illustrating a relationship between the length of an elastic member and the tension of a string in an ascending operation mode according to various embodiments.

When an ascending operation mode is set for an exercise apparatus, the twisting of strings may change during exercise. A user may adjust an exercise intensity by adjusting the initially set degree of twisting of the strings. The graph shows a trajectory for any one exercise intensity (e.g., a first intensity), and trajectories for the other exercise intensities may have different starting points on the y-axis than that of the trajectory 710.

The user may perform an exercise that increases or decreases the length of an elastic member connected to a string. As the force applied by the user to the elastic member increases (e.g., as the length of the elastic member increases), the degree of twisting of the strings may increase so that the increment in the tension of a string at that time may increase.

Figure 8:
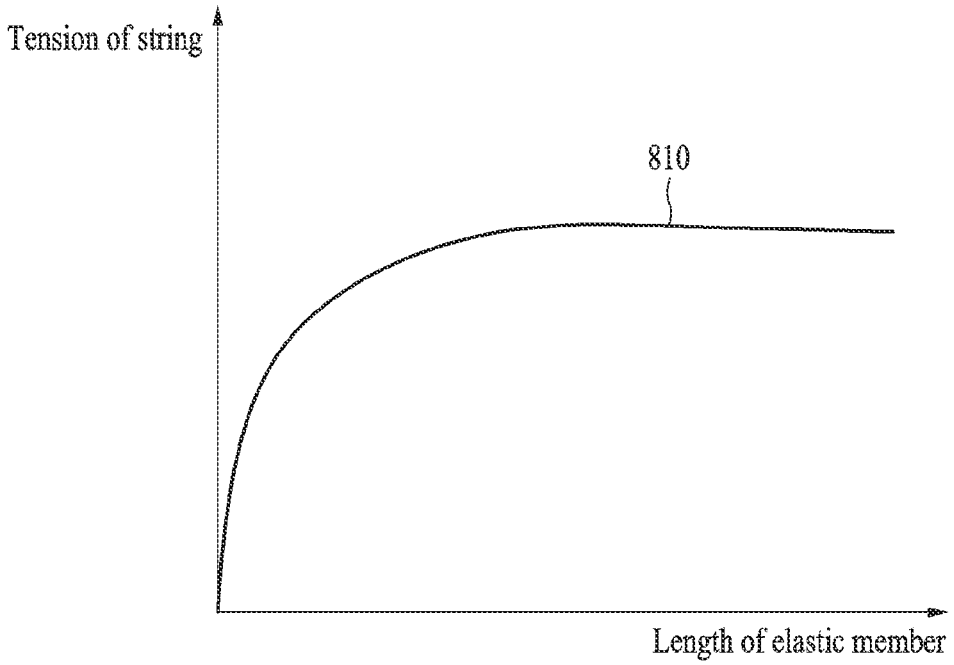
FIG. 8 is a graph illustrating the relationship between the length of an elastic member and the tension of a string in a descending operation mode according to various embodiments.

FIG. 8 is a graph illustrating a relationship between the length of an elastic member and the tension of a string in a descending operation mode according to various embodiments.

When a descending operation mode is set for an exercise apparatus, the twisting of strings may change during exercise. A user may adjust an exercise intensity by adjusting the initially set degree of twisting of the strings. The graph shows a trajectory for any one exercise intensity (e.g., a first intensity), and trajectories for the other exercise intensities may have different starting points on the y-axis than that of the trajectory 810.

The user may perform an exercise that increases or decreases the length of an elastic member connected to a string. As the force applied by the user to the elastic member increases (e.g., as the length of the elastic member increases), the degree of twisting of the strings may decrease so that the increment in the tension of a string at that time may decrease. For example, as the force applied by the user to the elastic member increases, the pre-twisted strings may be gradually untwisted.

Figure 9:
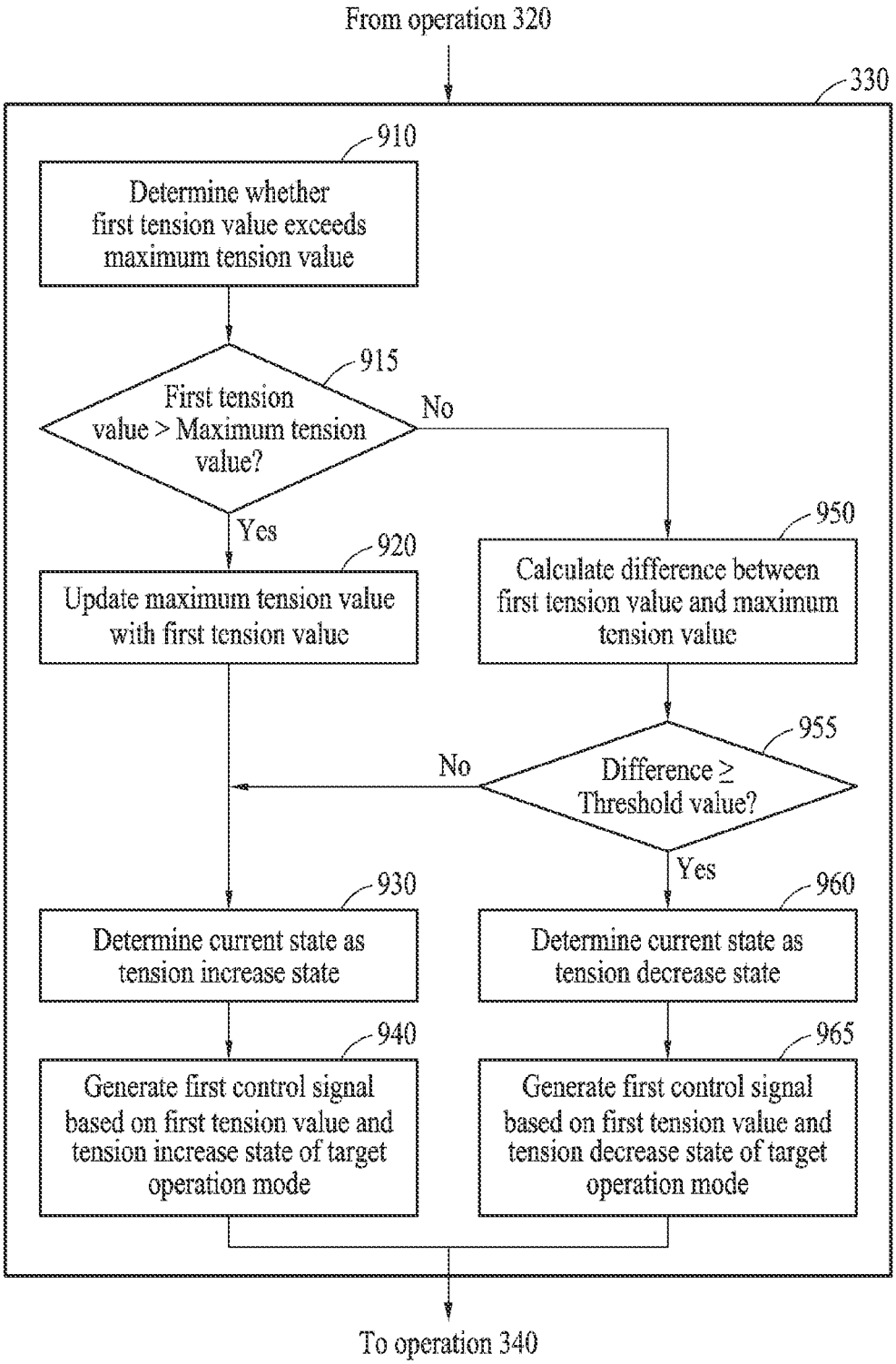
FIG. 9 is a flowchart illustrating an example method of generating a first control signal according to various embodiments.

FIG. 9 is a flowchart illustrating an example method of generating a first control signal according to various embodiments.

According to an embodiment, operation 330 described above with reference to FIG. 3 may include operations 910 to 965 to be described in greater detail below.

In operation 910, the controller 200 may determine whether a first tension value of a string generated by a sensor exceeds a maximum tension value. The maximum tension value may be initialized to "0" when a new exercise cycle (or repeated cycle) is performed.

Operation 920 may be performed when the first tension value exceeds the maximum tension value (Yes in operation 915), and operation 950 may be performed otherwise (No in operation 915).

In operation 920, the controller 200 may update the maximum tension value with the first tension value when the first tension value exceeds the maximum tension value.

In operation 930, the controller 200 may determine the current state as a tension increase state.

In operation 940, the controller 200 may generate a first control signal based on the first tension value and the tension increase state of the target operation mode.

For example, in an offset operation mode, a first control signal may not be generated, or a first control signal for continuously suspending the movement of a motor may be generated.

For example, in an ascending operation mode, a first control signal for providing an increase in the load according to an increase in the twisting of the strings along with an increase in the tension by the force applied by the user to an elastic member to the user may be generated. The twisting of the strings may be increased by the first control signal. For example, the first control signal may be generated so that the trajectory 710 of FIG. may appear.

For example, in a descending operation mode, a first control signal for untwisting the strings to offset an increase in the tension caused by the force applied by the user to an elastic member may be generated. The twisting of the strings may be decreased by the first control signal, and the load that the user may feel may decrease. For example, the first control signal may be generated so that the trajectory 810 of FIG. 8 may appear.

Operations 950 to 965 may be performed in a tension decrease state.

In operation 950, the controller 200 may calculate a difference between the first tension value and the maximum tension value when the first tension value does not exceed the maximum tension value.

In operation 955, the controller 200 may determine whether the calculated difference is greater than or equal to a threshold value. Operations 950 and 960 may be performed to prevent and/or reduce malfunction due to rapid fluctuations in the tension value near the maximum ROM of a joint since the tension of a string may be changed by an elastic member. For example, the threshold value may be preset. In another example, the threshold value may be calculated as 90% of the maximum tension value, and is not limited to the embodiment of the described numerical value.

If the calculated difference is equal to or greater than the threshold value, operation 960 below may be performed. Otherwise, operation 930 may be performed.

When operation 930 is performed through operation 955, the controller 220 may determine the current state as a tension increase state, but in practice, the current state may be understood as a tension maintenance state for transition to a tension decrease state. For example, when operation 930 is performed through operation 955, the current state may be determined as a tension maintenance state.

In operation 960, the controller 200 may determine the current state as a tension decrease state when the calculated difference is greater than or equal to the threshold value.

In operation 965, the controller 200 may generate a first control signal based on the first tension value and the tension decrease state of the target operation mode.

For example, in the offset operation mode, a first control signal may not be generated, or a first control signal for continuously suspending the movement of a motor may be generated.

For example, in the ascending operation mode, a first control signal for providing a decrease in the load according to a decrease in the twisting of the strings along with a decrease in the tension by the force applied by the user to an elastic member to the user may be generated. The twisting of the strings may be decreased by the first control signal.

For example, in the descending operation mode, a first control signal for increasing the twisting of the strings to offset a decrease in the tension caused by the force applied by the user to an elastic member may be generated. The twisting of the strings may be increased by the first control signal, and the load that the user may feel may increase.

According to an embodiment, whether the first tension value exceeds an initial threshold value may be determined before operation 910 is performed. When the first tension value does not exceed a first idle threshold value, the current state may be determined as an idle state. When the first tension value exceeds the first idle threshold value, the current state may be changed from the idle state to the tension increase state, and operation 910 may be performed in the tension increase state.

According to an embodiment, whether the first tension value exceeds a second idle threshold value may be determined after operation 950 is performed. For example, the second idle threshold value may be less than the first idle threshold value. When the first tension value does not exceed the second idle threshold value, the current state may be changed from the tension decrease state to the idle state.

Figure 10:
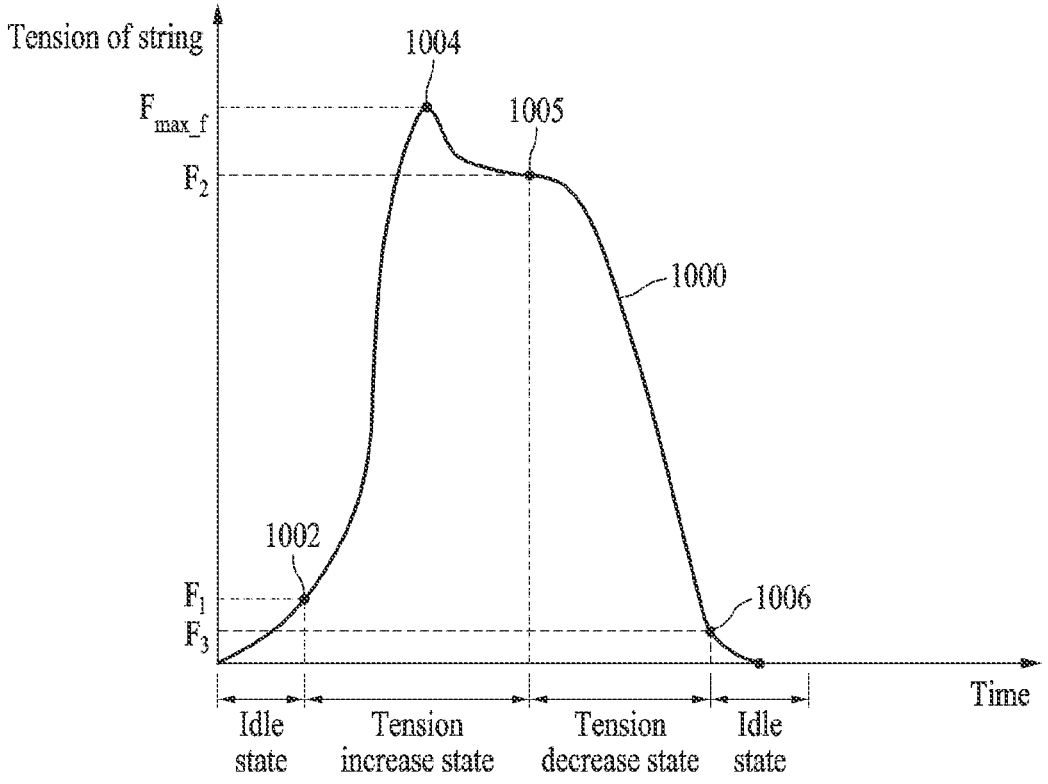
FIG. 10 is a graph illustrating a trajectory of tension of a string caused by an upper body exercise of a user according to various embodiments.

FIG. 10 is a graph illustrating an example trajectory of tension of a string caused by an upper body exercise of a user according to various embodiments.

According to an embodiment, a trajectory 1000 shows a change in the tension value of a string while a user performs an upper body exercise. For example, the trajectory 1000 may be a change in the tension value of a string when the operation mode of the exercise apparatus described above is an offset operation mode.

For example, a user may start stretching an elastic member while extending the elbow. When the user starts exercising, the tension value of the string may increase. At this time, the current state of the exercise apparatus may be determined as a tension increase state from a point in time 1002 when the measured tension value exceeds a first idle threshold value $F_1$, and a motor control signal for the tension increase state may be generated. As the tension value increases until a point in time 1004, the maximum tension value may be continuously updated.

Although the measured tension value decreases in an interval between the point in time 1004 and the point in time 1005, the current state may be maintained as the tension increase state. Alternatively, the above interval may be defined as a tension maintenance state.

From the point in time 1005 when the measured tension value is less than a threshold value $F_2$, the current state of the exercise apparatus may be determined as a tension decrease state, and a motor control signal for the tension decrease state may be generated.

From a point in time 1006 when the measured tension value is less than a second idle threshold value $F_3$, the current state of the exercise apparatus may be determined as an idle state, and a motor control signal may not be generated in the idle state.

Figure 11:
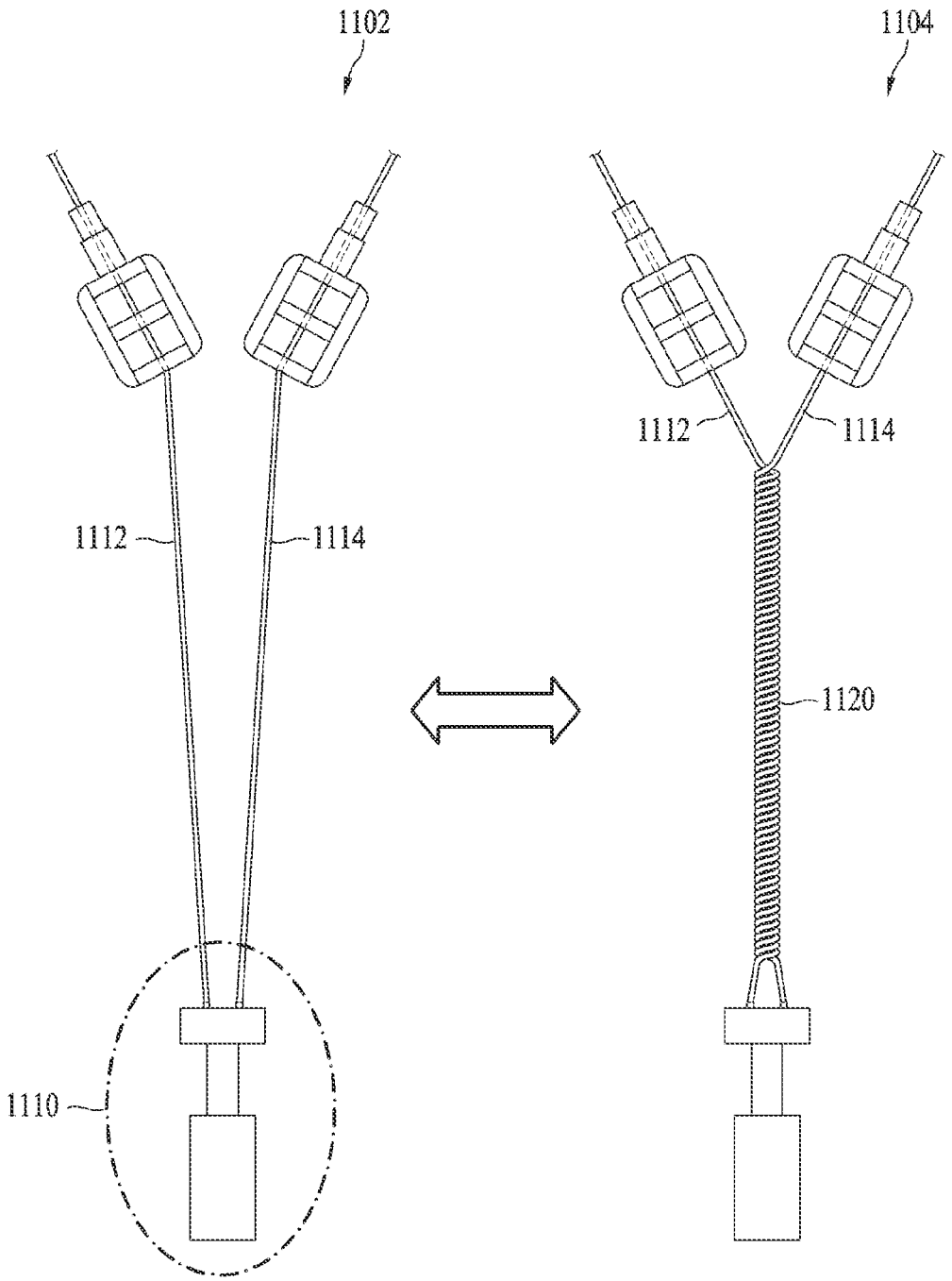
FIG. 11 is a diagram illustrating a change in the twist between a first string and a second string according to various embodiments.

FIG. 11 is a diagram illustrating example change in the twist between a first string and a second string according to various embodiments.

According to an embodiment, the degree of twisting of strings 1112 and 1114 (e.g., the strings 142 and 144 of FIG. 1) may change based on the driving of a motor 1110 (e.g., the motor 130 of FIG. 1). For example, the motor 1110 may be a twisted string actuator (TSA) configured to control the twisting of the strings 1112 and 1114.

Even when a user takes the same pose with respect to elastic members (e.g., the elastic members 152 and 154 of FIG. 1) connected to the strings 1112 and 1114, the user may feel a different load depending on the degree of twisting of the strings 1112 and 1114. For example, when the strings 1112 and 1114 are twisted a lot, the user may feel the force that the exercise apparatus pulls the elastic members backward strongly, and when the strings 1112 and 1114 are twisted a bit, the user may feel the force that the exercise apparatus pulls the elastic members backward loosely.

A first state 1102 shows the state of the strings 1112 and 1114 not twisted, and a second state 1104 shows the state of the strings 1112 and 1114 twisted a lot. A twisted state 1120 of the strings 1112 and 1114 may be controlled by rotating a motor head of the motor 1110 connected to the strings 1112 and 1114.

Figure 12:
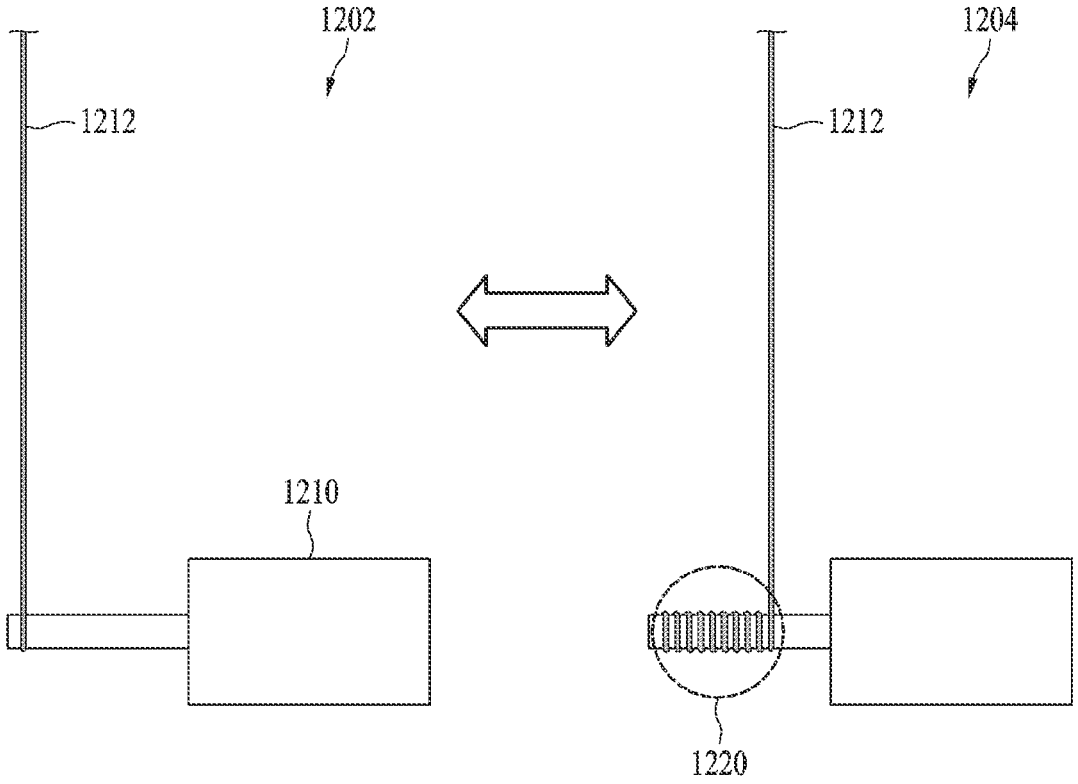
FIG. 12 is a diagram illustrating a change in the length of a string wound on a rotating shaft of a motor according to various embodiments.

FIG. 12 is a diagram illustrating example change in the length of a string wound on a rotating shaft of a motor according to various embodiments.

Although the exercise apparatus for controlling the tension of a string using twisting between a pair of strings has been described with reference to FIGS. 1 to 11, only one string 1212 may be connected to a motor 1210 according to an embodiment. In this embodiment, a first end of the string 1212 may be connected to the motor 1210, and a second end thereof may be simultaneously connected to a plurality of strings respectively corresponding to the left and right arms of the user. The motor 1210 may control the tension of the string 1212 by winding or unwinding the string on a rotating shaft of the motor 1210.

Even when the user takes the same pose with respect to elastic members connected to the string 1212, the user may feel a different load depending on the length of the string 1212. For example, when the length of the string 1212 decreases, the user may feel the force that the exercise apparatus pulls the elastic members backward strongly, and when the length of the string 1212 increases, the user may feel the force that the exercise apparatus pulls the elastic members backward loosely.

A first state 1202 shows the state of the string 1212 with the length increased, and a second state 1204 shows the state of the string 1212 with the length decreased. A wound state 1220 of the string 1212 may be controlled by rotating the motor 1210 connected to the string 1212.

Figure 13:
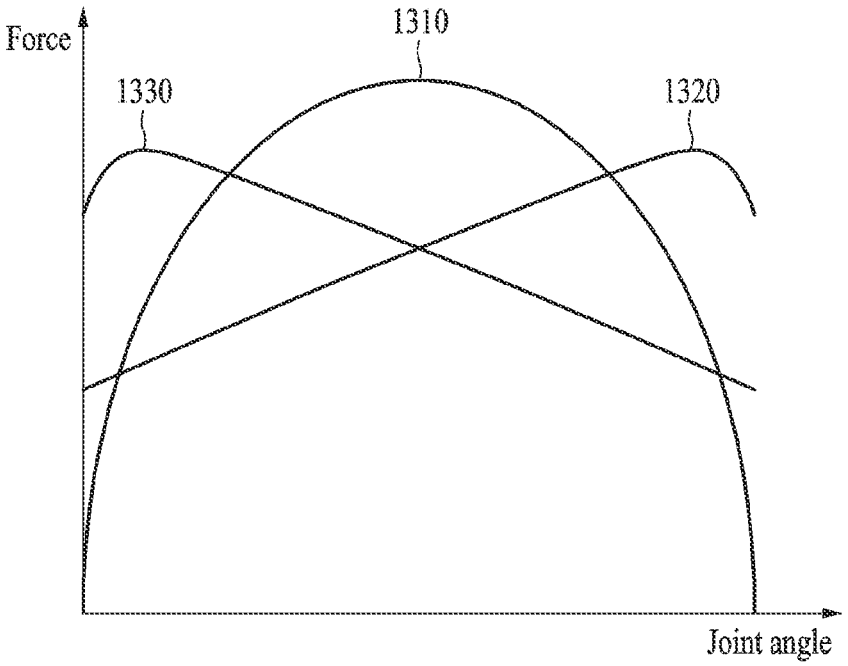
FIG. 13 is a graph illustrating the relationship between the angle of a users joint and force generated by a muscle of the joint according to an exercise method according to various embodiments.

FIG. 13 is a graph illustrating example relationships between the angle of a user's joint and force generated by a muscle of the joint according to an exercise method according to various embodiments.

For example, a first trajectory 1310 may be a trajectory of force that appears while a user performs a standing barbell curl. An offset operation mode of an exercise apparatus may be used to provide the user with an exercise effect similar to that of the first trajectory 1310.

For example, a second trajectory 1320 may be a trajectory of force that appears while the user performs a preacher curl. A descending operation mode of the exercise apparatus may be used to provide the user with an exercise effect similar to that of the second trajectory 1320.

For example, a third trajectory 1330 may be a trajectory of force that appears while the user performs a spider curl. An ascending operation mode of the exercise apparatus may be used to provide the user with an exercise effect similar to that of the third trajectory 1330.

The methods according to the various above-described example embodiments may be recorded in non-transitory computer-readable media including program instructions to implement various operations of the above-described embodiments. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher-level code that may be executed by the computer using an interpreter. The above-described devices may be configured to act as one or more software modules in order to perform the operations of the above-described embodiments, or vice versa.

A number of embodiments have been described above. Nevertheless, it should be understood that various modifications may be made to these embodiments. For example, suitable results may be achieved if the described techniques are performed in a different order and/or if components in a described system, architecture, device, or circuit are combined in a different manner and/or replaced or supplemented by other components or their equivalents.

Therefore, other implementations, other embodiments, and equivalents to the claims are also within the scope of the following claims. It will also be understood that any of the embodiment(s) described herein may be used in connection with any other embodiment(s) described herein.

What is claimed is:

1. A method of controlling tension of a string of a tension control apparatus, performed by the tension control apparatus, the method comprising:

receiving a target operation mode of the tension control apparatus;

generating a first tension value by measuring tension of a string connected to at least one sensor using the at least one sensor;

generating a first control signal for controlling a motor connected to the string based on the first tension value and the target operation mode, wherein the string is connected to an elastic member comprising an elastic material and to at least one handle configured for gripping by a user such that the string is interposed between the elastic member/at least one handle and the motor, and wherein the tension is applied to the string using the elastic member; and controlling tension of the string by controlling the motor based on the first control signal.

2. The method of claim 1, wherein the receiving of the target operation mode comprises:

receiving the target operation mode;

generating an initial control signal for controlling the motor so that the string has initial tension specified for the target operation mode; and controlling the tension of the string by controlling the motor based on the initial control signal.

3. The method of claim 2, wherein the receiving of the target operation mode further comprises receiving a target intensity for the target operation mode, and the generating of the initial control signal comprises generating the initial control signal for controlling the motor so that the string has the initial tension specified for the target operation mode and the target intensity.

4. The method of claim 1, wherein the target operation mode includes an offset operation mode in which the length of the string located between the motor and the elastic member does not change even when tension is applied to the string by the user.

5. The method of claim 1, wherein the target operation mode includes an ascending operation mode in which the length of the string located between the motor and the elastic member decreases based on the tension applied to the string increasing.

6. The method of claim 5, wherein the ascending operation mode includes an operation mode in which the length of the string located between the motor and the elastic member increases based on the tension applied to the string decreasing after reaching a maximum value.

7. The method of claim 1, wherein the target operation mode includes a descending operation mode in which the length of the string located between the motor and the elastic member increases based on the tension applied to the string increasing.

8. The method of claim 7, wherein the descending operation mode includes an operation mode in which the length of the string located between the motor and the elastic member decreases based on the tension applied to the string decreasing after reaching a maximum value.

9. The method of claim 1, wherein the generating of the first control signal for controlling the motor connected to the string based on the first tension value and the target operation mode comprises:

determining whether the first tension value exceeds a maximum tension value;

updating the maximum tension value with the first tension value based on the first tension value exceeding the maximum tension value;

determining a current state as a tension increase state based on the maximum tension value being updated; and generating the first control signal for controlling the motor connected to the string based on the first tension value and the tension increase state of the target operation mode.

10. The method of claim 1, wherein the generating of the first control signal for controlling the motor connected to the string based on the first tension value and the target operation mode comprises:

determining whether the first tension value exceeds a maximum tension value;

calculating a difference between the first tension value and the maximum tension value based on the first tension value not exceeding the maximum tension value;

determining a current state as a tension decrease state based on the difference being greater than or equal to a specified threshold value; and generating the first control signal for controlling the motor connected to the string based on the first tension value and the tension decrease state of the target operation mode.

11. A method of controlling tension of a string of a tension control apparatus, performed by the tension control apparatus, the method comprising:

receiving a target operation mode of the tension control apparatus;

generating a first tension value by measuring tension of a string connected to at least one sensor using the at least one sensor;

generating a first control signal for controlling a motor connected to the string based on the first tension value and the target operation mode; and controlling tension of the string by controlling the motor based on the first control signal, wherein the string is connected to an elastic member comprising an elastic material, wherein tension is applied to the string using the elastic member, wherein:

the string comprises a plurality of strings, and the motor comprises a twisted string actuator (TSA) configured to control twisting of the plurality of strings.

12. The method of claim 1, wherein the motor is configured to control tension of the string by winding or unwinding the string on a rotating shaft of the motor.

13. The method of claim 1, wherein the string comprises a first string and a second string, the first string of the string is connected to a first elastic member, and the second string of the string is connected to a second elastic member.

14. A non-transitory computer-readable storage medium storing instructions that, when executed by a processor, cause a tension control apparatus to perform the method recited in claim 1.

15. A tension control apparatus comprising:

a string having a first end connected to an elastic member comprising an elastic material and at least one handle configured for gripping by a user and a second end connected to a motor such that the string is interposed between the elastic member/at least one handle and the motor;

at least one sensor configured to generate a first tension value by measuring tension of the string; and a controller configured to generate a first control signal for controlling the motor based on the first tension value received from the at least one sensor and a set target operation mode;

a motor driver circuit configured to control tension of the string by controlling the motor based on the first control signal; and the motor electrically connected to the motor driver circuit, wherein the apparatus is configured to apply tension to the string using the elastic member.

16. The apparatus of claim 15, further comprising:

at least one user interface configured to receive the target operation mode.

17. The apparatus of claim 15, further comprising:

communication module comprising communication circuitry configured to receive the target operation mode from a user terminal.

18. The apparatus of claim 15, wherein the string comprises a plurality of strings, and the motor comprises a twisted string actuator (TSA) configured to control twisting of the plurality of strings.

19. The apparatus of claim 15, wherein the motor is configured to control tension of the string by winding or unwinding the string on a rotating shaft of the motor.

* * * * *